United States Patent [19]

Fulbright, Jr.

[11] 4,133,062

[45] Jan. 9, 1979

[54] LIFTING APPARATUS FOR TOILET SEAT

[76] Inventor: Burley R. Fulbright, Jr., 8145 E. Elm Dr., Scottsdale, Ariz. 85257

[21] Appl. No.: 875,867

[22] Filed: Feb. 7, 1978

[51] Int. Cl.[2] ..... A47K 3/10; A47K 17/00; E03D 13/00

[52] U.S. Cl. ..... 4/251; 4/1; 4/DIG. 5; 4/301

[58] Field of Search ..... 4/251, 1, 249, 301, 4/307, 312, 149, 153, 154, 239, 237, 185 R, 134, 135, DIG. 5, 253, 90, 263; 128/283; D23/53

[56] References Cited

U.S. PATENT DOCUMENTS

| | | | |
|---|---|---|---|
| 2,791,780 | 5/1957 | Krischen | 4/1 |
| 2,980,919 | 4/1961 | Otto et al. | 4/1 |
| 3,071,778 | 1/1963 | Renshaw | 4/1 |
| 3,193,845 | 7/1965 | Funk | 4/1 |
| 3,350,722 | 11/1967 | Moreschini | 4/1 |
| 3,914,803 | 10/1975 | Gregovski | 4/1 |
| 3,931,649 | 1/1976 | Jankowski | 4/1 |
| 4,060,859 | 12/1977 | Anderson | 4/300 |

*Primary Examiner*—Henry K. Artis
*Attorney, Agent, or Firm*—H. Gordon Shields

[57] ABSTRACT

Apparatus is disclosed for lifting a toilet seat of a conventional toilet to convert a conventional toilet into a urinal.

19 Claims, 11 Drawing Figures

LIFTING APPARATUS FOR TOILET SEAT

BACKGROUND OF THE DISCLOSURE

1. Field of the Invention

This invention relates to toilets and, more particularly, to the conversion of a conventional toilet into a urinal by raising the toilet seat and thereby to unfold a curtain extending between the toilet bowl and the seat to convert the toilet into a urinal.

2. Description of the Prior Art

As is well-known and understood, a toilet seat and cover are typically hinged to a toilet bowl and the seat and cover simply pivot upwardly and rearwardly to be disposed against the toilet tank when the toilet is used as a urinal. As is also well-known and understood in the art, a very common problem, particularly associated with men and boys, is the problem of splashing. The splashing causes problems of odor, soil, and the like, in most cases behind the toilet seat and on the floor to the rear of the toilet and beneath the toilet tank. These problems are age-old problems, and have heretofore been not entirely successfully solved.

At least two United States patents are included in the prior art concerned in at least some part with solving the problems discussed in the preceding paragraph. The two patents are U.S. Pat. No. 2,839,764, and U.S. Pat. No. 3,193,845. The '764 patent discloses a toilet seat hinge cover which is secured to and extends downwardly from the rear of the toilet seat to protect the hinge of the toilet seat when the toilet seat is raised. The hinge cover extends for only a relatively short arcuate distance and is designed only to protect the immediate vicinity of the toilet seat hinge, or the back of the toilet seat, from splashing, and the like. The '845 patent discloses a pleated and collapsible splash shield which is secured to both the toilet seat and the toilet bowl. The connection between the splash shield and the toilet seat is at the bottom back portion of the seat to prevent splashing from contacting the back portion of the seat and in the area of the toilet seat hinge. The pleated splash shield is also secured to the top of the toilet bowl rim and accordingly provides splash protection from the immediate area of the toilet bowl rim.

In both patents discussed in the preceding paragraph, the shields involved are secured to the toilet seat and accordingly provide protection when the toilet seat pivots backwardly against the toilet tank. This, in each case, limits the effectiveness of the shielding attempts. Moreover, there is no protection against a misdirected stream of urine, as is likely to happen, especially with children. The apparatus of the present invention overcomes the problems and deficiencies of the prior art and offers protection in a manner not heretofore contemplated by the prior art.

SUMMARY OF THE INVENTION

The invention described and claimed herein comprises a collapsible splash shield secured to both a toilet bowl and a toilet seat and the shield extends into place when the toilet seat lifts upon being pivoted to allow access to the toilet bowl. The lifting of the toilet seat is accomplished by a pair of rods springloaded in the "up" position which move vertically through a pair of spaced apart and parallel holes or bores which extend through the rear flange of a toilet bowl.

Among the objects of the present invention are the following:

To provide new and useful toilet seat apparatus;

To provide new and useful toilet seat apparatus which raises above the toilet seat;

To provide new and useful apparatus for shielding a toilet;

To provide new and useful apparatus for converting a conventional toilet into a urinal;

To provide new and useful apparatus for lifting a toilet seat;

To provide new and useful foldable toilet seat shield apparatus; and

To provide new and useful apparatus for shielding a toilet seat and the area about the toilet from undesirable splashing.

DESCRIPTION OF THE PREFERRED EMBODIMENT

Figure 1:
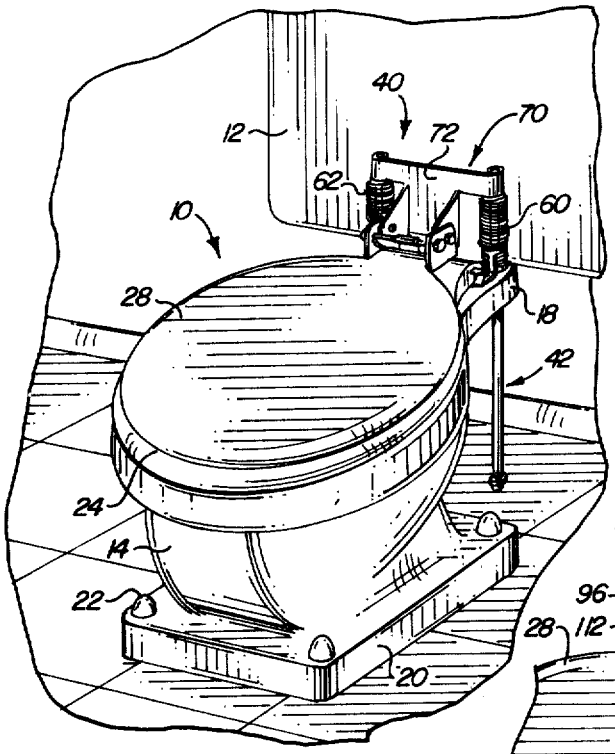
FIG. 1 is a perspective view of a toilet including the apparatus of the present invention.

FIG. 1 is a perspective view of toilet apparatus 10 including a toilet tank 12 and showing a toilet bowl 14 secured to the toilet tank 12. The toilet tank 12 and the toilet bowl 14 are well known in the art and their securement to a wall and a floor, respectively, are well known and understood. Moreover, the securing of the toilet tank to the toilet bowl is also well known and understood in the art.

Figure 2:
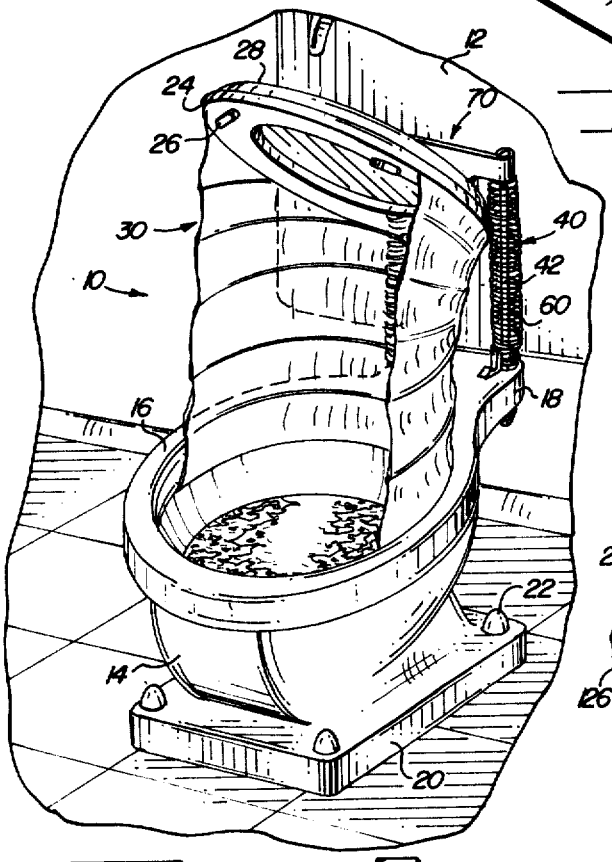
FIG. 2 is a perspective view of the apparatus of FIG. 1 showing the deployment of the apparatus of the present invention.

The toilet bowl 14 includes a rim 16, as shown in FIG. 2, and with a rearwardly extending flange 18 extending rearwardly from the rim 16 and beneath the toilet tank 12. The direct connection between the tank and the bowl for the flow of water from the tank to flush the toilet is, of course, by way of the flange 18 and internal water passages within the bowl 14. The bowl is disposed on a base 20 which in turn is secured to a floor by means of threaded studs which extend upwardly from the floor and through appropriate holes or apertures in the base 20. The studs and nuts are covered by covers 22.

A conventional toilet seat 24, with a toilet seat cover 28 disposed above the toilet seat 24, is employed with the present apparatus. As shown in FIG. 2, the toilet seat 24 is of a conventional configuration and includes a plurality of pads 26 which extend downwardly from the bottom surface of the toilet seat and against the top of the rim 16 of the toilet bowl when the seat is in its down position. Both the toilet seat 24 and its cover 28 are secured together and are pivotable, and, as illustrated in FIG. 2, both raise upwardly as part of the apparatus of the present invention to convert an otherwise relatively standard and well-known toilet into a urinal.

Associated with the toilet 10 is lifting apparatus 40, illustrated in FIGS. 1, 2, 3, and 4. In FIG. 1, the lifting apparatus 40, with the toilet seat 24 and its cover 28, are shown in the down position, and the toilet seat cover 28 is disposed on the toilet seat 24. In FIG. 2, the toilet seat 24, with its cover 28, is shown in the up position, as secured to and lifted by the lifting apparatus 40. It will be noted that both the toilet seat and the cover are secured to and pivotable on the lifting apparatus 40. Moreover, the toilet seat cover 28 may be pivoted in the common, well-known manner, to expose the toilet seat for normal usage. The toilet seat cover 28 accordingly pivots rearwardly and upwardly, in the common or conventional manner, to be disposed against the toilet tank 12 or the lifting apparatus 40 during normal use of the toilet 10. However, when it is desirable to do so, both the toilet seat and its cover may be lifted upwardly to enable the toilet to be used as the urinal, or to employ a splash shield, which is deployed or opened in an accordian like manner as the seat is raised to prevent splashinng rearwardly of the toilet bowl.

FIG. 2 comprises a perspective view of the apparatus of FIG. 1, showing the toilet seat 24 and its cover 28 lifted by the lifting apparatus 40. A collapsible splash shield 30 is shown extending between the toilet seat 24 and the toilet bowl 14. The splash shield is appropriately secured to both the toilet bowl and the toilet seat. The toilet bowl 24, secured to the lifting apparatus 40, is disposed at an angle intermediate its full down or closed position, as shown in FIG. 1, and an upwardly and rearwardly pivoted position, not shown, but standard and well-known and understood as is common with the ordinary "up" position of toilet seats and their covers. The intermediate angular position shown in FIG. 2 allows the splash shield 30, secured to the underneath portion of the toilet seat, to be deployed in its full open position, which is somewhat more than a 180° arc extending from one side of the toilet bowl, and to the opposite side of the toilet bowl. The splash shield thus completely covers the back or rear portion of the toilet bowl to prevent splashing and waste residue from penetrating to the rear of the toilet bowl and also to the rear sides of the toilet bowl.

The lifting apparatus 40 includes a pair of rods, of which a rod 42 is shown in FIG. 2. The rod is movable in or through a hole or aperture in the rear flange 18 of the toilet bowl 14. Secured to the pair of rods at the top or upper portion of the rods is a bracket 70. A pair of springs, such as spring 60, is disposed circumferentially about the rods to provide an upward bias for the rods and the bracket 70. The springs, such as spring 60 disposed about the rod 42, are compression springs which extend between the upper surface of the flange 18 and the lower surface of the bracket 70.

Figure 3:
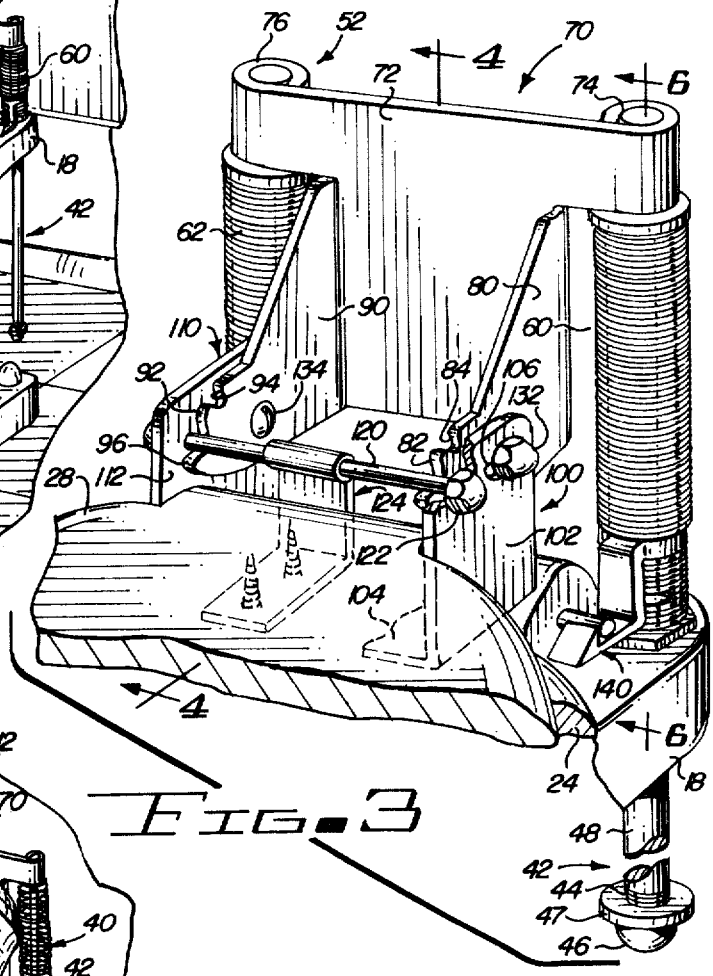
FIG. 3 is an enlarged view of a portion of the lifting apparatus for the toilet seat included in the present invention.
Figure 4:
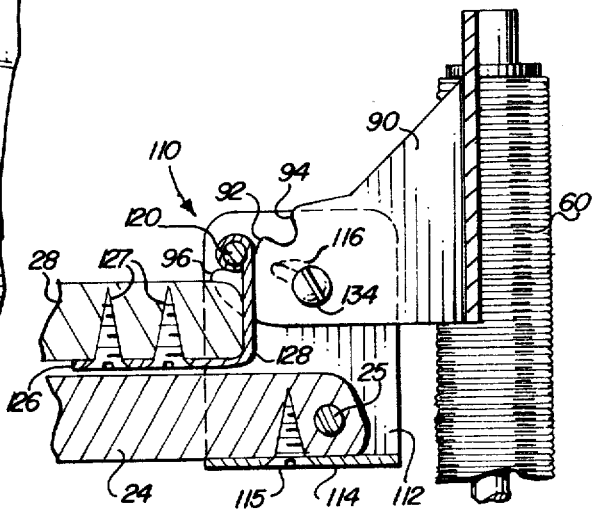
FIG. 4 is an enlarged view in partial section of the apparatus of FIG. 3 taken generally along line 4—4 of FIG. 3.

The coordination and cooperation between the toilet seat 24 and the lifting apparatus 40 is illustrated in FIGS. 3, 4, 5, and 6. FIG. 3 is an enlarged view of a portion of the apparatus of FIGS. 1 and 2, comprising a perspective view of the lifting apparatus 40. FIG. 4 is an enlarged view in partial section of the apparatus of FIG. 3 taken generally along line 4—4 of FIG. 3.

Figure 5:
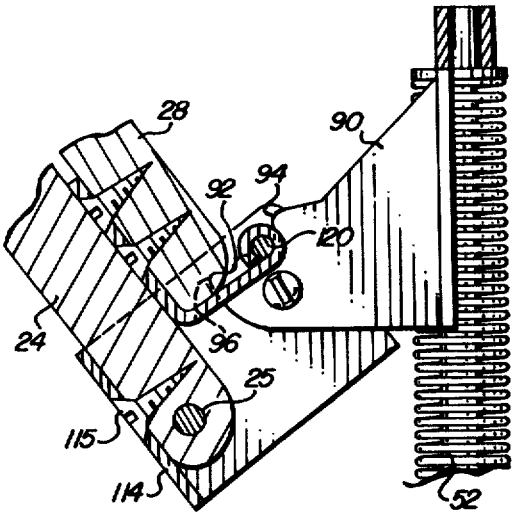
FIG. 5 is an enlarged view of the apparatus of FIG. 4 illustrating the sequential movement of the toilet seat.

FIG. 5 is an enlarged view of the apparatus of FIG. 4 illustrating the sequential movement of the toilet seat 24 to the upward position from that shown in FIG. 4.

Figure 6:
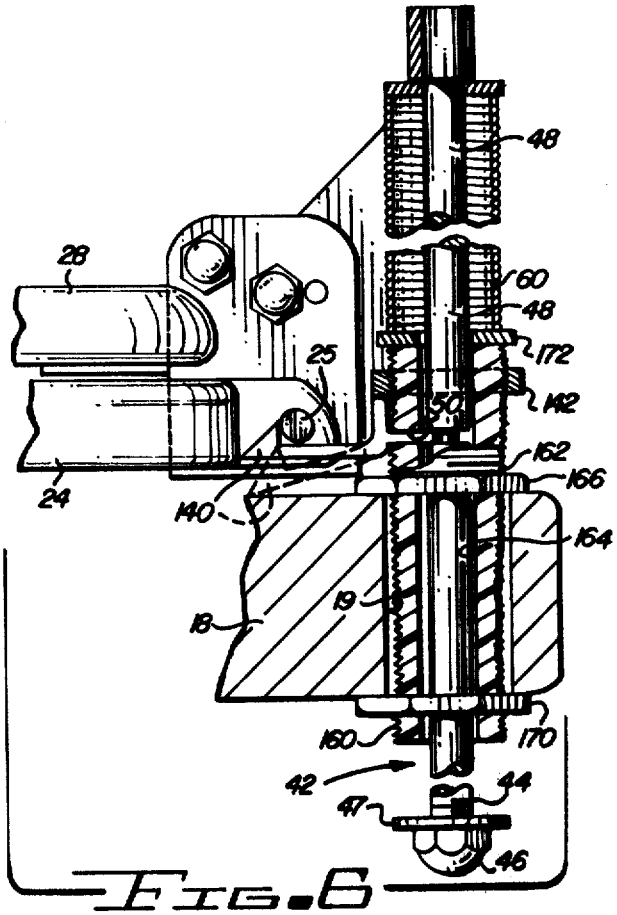
FIG. 6 is an enlarged view in partial section of a portion of the apparatus of FIG. 3 taken generally along line 6—6 of FIG. 3.

FIG. 6 is an enlarged view in partial section of a portion of the apparatus of FIG. 3 taken generally along line 6—6 of FIG. 3. The description of the lifting apparatus 40 which follows will refer to FIGS. 3, 4, 5, and 6.

As best shown in FIG. 6, the rear flange 18 of the toilet 10 includes a vertically extending hole or bore 19 which extends through the rear flange 18. Disposed within the hole or bore 19 is a bushing 160. The bushing 160 is preferably made of a plastic or nylon material, well known in the art. The bushing includes external threads 162 and an internal bore 164. The bushing 160 is held in place by a pair of retainer nuts 166 and 170. The retainer nut 166 is the upper retainer nut, while the nut 170 is the lower retainer nut, and both are disposed with respect to the bushing 160 so as to maintain the bushing within the hole or bore 19 to serve as a guide for the rod 42. The hole or bore 19 has a parallel hole or bore disposed at the opposite end or opposite side of the flange 18 to receive another bushing for the rod 52. The rods 42 and 52 are parallel, and accordingly the elements associated with each bore are substantially identical. For illustrative purposes, only the rod 42 is illustrated and will be discussed. However, it will be understood that the rod 52, with its particular elements, bore bushings, and the like, are substantially identical to that illustrated and discussed with reference to rod 42 in FIG. 6.

The bushing 160 is disposed in the bore 19 and is held in place between the retainer nuts 166 and 170, with a substantial portion of the bushing 160 extending upwardly above the flange 18 to receive a portion of the lock apparatus, as will be discussed in detail below, which locks the toilet seat in its down position, and, when unlocked, allows the toilet seat to be raised through the upward bias of the pair of springs, such as spring 60 shown in FIGS. 2, 3, and 6, together with the spring 62, shown in FIGS. 3, 4, and 5.

The rods 42 and 52 are substantially identical, and, again by reference to FIG. 6, their details may be understood. The rod 42 includes a lower threaded portion 44 to which is secured a bottom cap 46. The cap preferably includes a radially outwardly extending flange 47 which acts as a stop for the upward travel of the rods. The outwardly extending flange 47, which may, if desired, be a separate flat washer, acts as a stop by bearing against the bottom or lower end of bushing 100. Above the lower threaded portion 44, and comprising substantially the balance of the rod 42, is a smooth cylindrical portion 48. The length of the rod 42, and also of the rod 52, is determined by the total height to which the toilet seat 24 will be raised, and may be, in part, determined or limited by the distance between the floor and the flange 18 of the toilet.

Secured to the upper portion of the rods 42 and 52 is a bracket 70. The bracket 70 includes a flat portion 72 which extends transversely between the rods and vertically downwardly from a pair of cylinder guides 74 and 76. The cylinder guides 74 and 76 are in turn secured respectively to the upper portions of the rods 42 and 52. Downwardly from the cylinder guides 74 and 76 with respect to the flat portion 72, are a pair of flanges 80 and 90 which extend forwardly from the flat portion 72. The flanges 80 and 90 are substantially perpendicular to the flat portion 72, and as illustrated in FIG. 3, are both of a generally triangular configuration, with the base of the triangle comprising the bottom of the respective flanges which extend outwardly from the bottom portion of the flat portion 72 at generally a right angle thereto. At the lower forward portion of the flanges 80 and 90 are a pair of rounded cam portions 82 and 92, respectively. A pair of recesses 84 and 94 extend downwardly and inwardly from the upper termination of the cam portions 82 and 92. The recesses receive rod 120 which extends between, and is appropriately secured to, a pair of brackets 100 and 110 which are in turn secured to the toilet seat 24 and its cover 28.

As best shown in FIGS. 3 and 4, the toilet seat cover 28 is secured to the rod 120 by a bracket 124 which is generally of an "L" shaped configuration, and it includes a horizontally extending portion 126 and a vertically extending portion 128. The horizontally extending portion 126 is secured to the underneath surface of the toilet seat cover 28 by, as shown in FIG. 4, a pair of appropriate fasteners, such as screws 127. At the upper portion of the vertically extending portion 128 of the bracket 124 is a cylindrical portion 129 which extends about the rod 120, thus securing the cover 28 to the rod 120. As illustrated in FIG. 3, the rod 120 is secured to the brackets 100 and 110 by extending through a pair of aligned holes or apertures in the brackets and, at the outer or distal ends of the rod 120 which extends through the respective brackets 100 and 110, there are appropriate cap nuts, such as nut 122 shown in FIG. 3.

Brackets 100 and 110 are secured to the flanges 80 and 90 by a pair of appropriate fastening means, such as a pair of bolts and cap nuts. In FIG. 3 is shown a cap nut 132 which secures to the threaded shank portion of a bolt (not shown) to secure the bracket 100 to the flange 80. In turn, the bracket 100 is secured to the toilet seat 24 also by a plurality of fasteners, such as screws 115 shown in FIG. 4 to secure the toilet seat 24 to the horizontally extending foot portion of the bracket 110. In FIG. 3, the bracket 100 is shown as including a side or vertically extending plate 102 and a horizontally extending foot portion 104. The bracket 110, shown in FIGS. 3 and 4, is substantially like bracket 100, and it includes a vertically extending side plate 112 secured to a horizontally extending foot portion 114 through which the screws 115 extend. The seat 24, with its brackets 100 and 110, are movable relative to the bracket 70 by means of the recesses 84 and 94 in the flanges 80 and 90, respectively, and a pair of slots 106 and 116 in the brackets 100 and 110, respectively. As the toilet seat 24 pivots upwardly on the pair of bolts, of which bolt 134 is shown in FIGS. 3, 4, 5, and 6, and its corresponding bolt, of which fastener or cap nut 132 is shown in FIG. 3, the rod 120 moves on the cam portions 82 and 92 of the flanges 80 and 90. When the rod 120 reaches the recesses 84 and 94, the bolt or the rod moves into the recesses, and the slots 106 and 116 also move with respect to the respective bolts to allow the entire toilet seat and its cover to move relative to the flanges 80 and 90 to lock in place, in the position shown in FIG. 2. It will be noted that the bolts through the flanges 80 and 90 extend only through an aperture and the bolts accordingly remain in position. The slots 106 and 116 are only in the outer brackets 100 and 110 so that the brackets 100 and 110 move relative to the flanges 80 and 90 to lock in place by a pair of movements, a pivoting movement and a straight line downwardly and rearwardly movement. The relative movement thus causes the rod 120 to move into the recesses 84 and 94, and causes the slots 106 and 116 to move on the respective bolts secured to the flanges 80 and 90 to secure the toilet seat and its lid relative to the bracket 70.

FIG. 3 shows the toilet seat and cover in the "down" position disposed on the rim 16 of the toilet 10. The rods 42 and 52, secured to the bracket 70, are also in the full "down" position with the compression springs 60 and 62 fully compressed. The toilet seat and the bracket 72 are held in the "down" position by means of a locking pin which extends into an appropriate notch in the rod 42, as illustrated in FIGS. 3 and 6.

A locking member 140 is shown disposed about the bushing 160 in FIGS. 3 and 6. The locking member 140 is shown by itself in the perspective view of FIG. 7. The locking member 140 includes a cylindrical or circular strap portion 142 which encircles the upper portion of the bushing 160, as clearly shown in FIG. 6. The inner surface of the strap 142 may be threaded to threadedly engage the exterior of the bushing to help maintain the locking member 140 in position relative to both the seat 24 and the bushing 160. Extending downwardly from the circular strap is a vertical shank portion 144. Extending horizontally from the lower portion of the vertical shank 144, and in the opposite direction from the circular strap 142, is a horizontal shank portion 148. A pin 146 extends substantially parallel to the horizontal shank 144, but in the opposite direction, from the vertical shank 144. The pin 146 comprises a locking pin which extends into a slot 50 in the rod 42.

Figure 7:
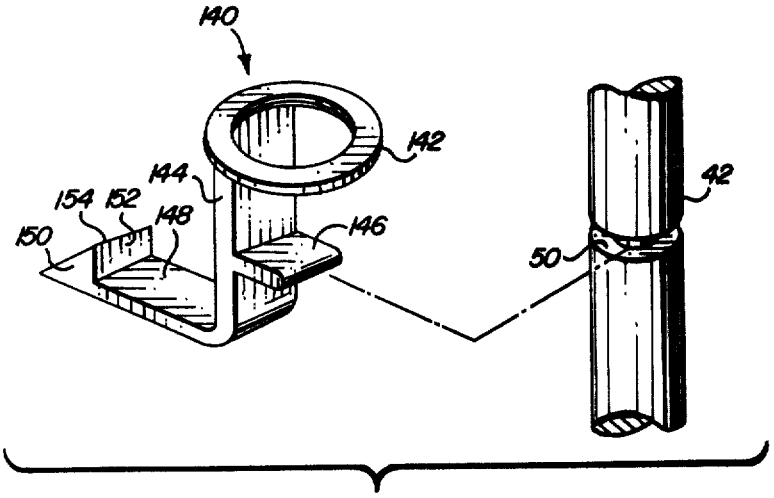
FIG. 7 is an enlarged perspective view of a portion of the apparatus of the present invention.

The locking member 140 is relatively flexible, thus allowing the vertical shank 144, with the pin 146 secured thereto, to move relative to the rod 42. This enables the locking pin 146 to extend into and be retracted out of, the slot 50. A portion of the rod 42, showing the slot 50, is shown in FIG. 7 spaced apart from the locking member 140.

At the distal end of the horizontal shank 148 of the locking member 140 is a locking cam 150. The locking cam 150 includes a vertically extending portion which includes a pair of faces, including a vertical face 152 which faces the vertical shank 144 and a sloping face 154. The sloping face 154 extends downwardly and outwardly with respect to the vertical face 152 and away from the horizontal shank 148.

The horizontal shank 148 is also flexible and thus is movable relative to the vertical shank 144 and also relative to the strap 142. The outward movement of the horizontal shank 148 may best be understood by reference to FIGS. 3 and 6. A latching pin 25 extends horizontally outwardly or sidewardly from the rear portion of the toilet seat 24, as shown in FIG. 3, and the pin is disposed against the locking member 140 between the vertical face 152 and the upper surface of the horizontal shank 148. In the position thus shown in FIGS. 3 and 6, the toilet seat 24 is in the "down" position, with the locking pin 146 extending into the slot 50 of the rod 42, thus preventing a vertical movement of the rod and of the bracket 70 to which is secured the seat 24.

The lifting and pivoting movement of the seat 24 causes the pin 25 to bear against the vertical face 152 of the locking cam 150, and a resulting outward movement of the locking member 140 occurs. When the pin 25 thus biases the locking member outwardly or away from the rod 42 a sufficient distance to cause the pin 146 to be fully removed from the slot 50, the seat 24 moves upwardly under the bias of the compression springs 60 and 62. Once the pin 146 has cleared the notch 50, the toilet seat, secured to the bracket 72 which is in turn secured to the rods 42 and 52, moves upwardly and away from the locking member 140. The locking member then returns to near its original orientation, at least with respect to the horizontal shank 148. The vertical shank will not be able to return to its normal "locked" position because the pin 146 is disposed against the cylindrical portion 48 of the rod 42. The notch or slot 50 in the rod 42 moves upwardly as the rod moves and the pin 146 accordingly must wait until the toilet seat and the rod returns to the "down" position to enable the pin 146 to again be seated in the slot 50.

In the "up" position, as illustrated in FIG. 5, the pin 25 is pivoted outwardly a further distance from the rods 42 and 52 than when the toilet seat is in the "down" position, as illustrated in FIGS. 3, 4, and 6. When the toilet seat is then returned to the "down" position, it is either moved downwardly with the seat remaining in the pivoted orientation as shown in FIG. 5, or somewhere between the position shown in FIG. 5 and the horizontal position shown in FIGS. 3, 4, and 6. If the seat remains in the full pivoted position as shown in FIG. 5, with the rod 120 remaining in the recesses 84 and 94, the seat may lock in place, providing there is sufficient space between the flange 18 of the toilet 10 and the brackets 100 and 110 to accommodate the seat 24 in the pivoted position and allow the locking pin 146 to extend into the notch 50. It will be noted that in order to unlock the seat from the position shown in FIG. 5, the seat must be moved upwardly to disengage the rod from the recesses 84 and 94, and at the same time allow the slots 106 of the brackets 100 and 110 to move relative to their appropriate bolts. In turn, this will allow the rod 120 to move over the cam portions 82 and 92 of the flanges 80 and 90, respectively.

When the seat 24 moves downwardly as the rod 120 moves along the cam surfaces 82 and 92, the pin 25 may engage either the upper surface of the horizontal shank portion 148 or the sloping face 154 of the locking cam 150. If the pin engages directly the upper surface of the horizontal shank, the seat will lock in its "down" position and remain locked as soon as the notch 50 moves by the outer tip or end of the locking pin 146. The locking pin 146 will move into the notch 50 under the inherent bias of the vertical shank 144. If the pin 25 contacts the sloping face 154 of the locking cam, the downward movement of the pin will cause the horizontal portion 148 to be cammed downwardly and away from the pin 25, and the relative motion between the sloping surface 154 and the pin 125 will ultimately allow the pin 125 to move into the space between the vertical space 152 and the horizontal shank 154 as the seat 24 reaches its full "down" or horizontal orientation.

The recesses 84 and 94 receive the rod 120 to lock the toilet seat 24 in an "up" position. When the rod 120 is removed from the recesses 84 and 94, the toilet seat is held in a horizontal position by a pair of stops 86 and 96, respectively, on the flanges 80 and 90 beneath the cam portions 82 and 92, as best seen in FIGS. 3, 4, and 5.

Figure 8:
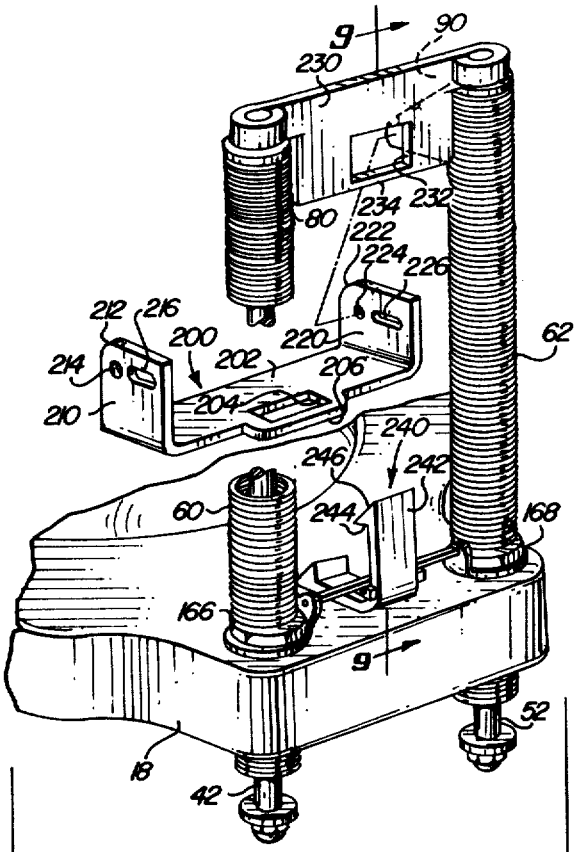
FIG. 8 is an enlarged perspective view, partially broken away, of a portion of the apparatus of the present invention comprising an alternate embodiment of a portion of the lifting apparatus for the toilet seat.

FIG. 8 is a partially exploded view of an alternate embodiment of the locking apparatus of the embodiment of FIGS. 1–7. The locking member 140, which engages one, or even both, if desired, of the vertical rods, is replaced in the embodiment of FIG. 8 by a centrally oriented locking member which engages directly a rearwardly extending extension of the brackets 100 and 110 and a portion of the plate 72 of the bracket 70.

Figure 9:
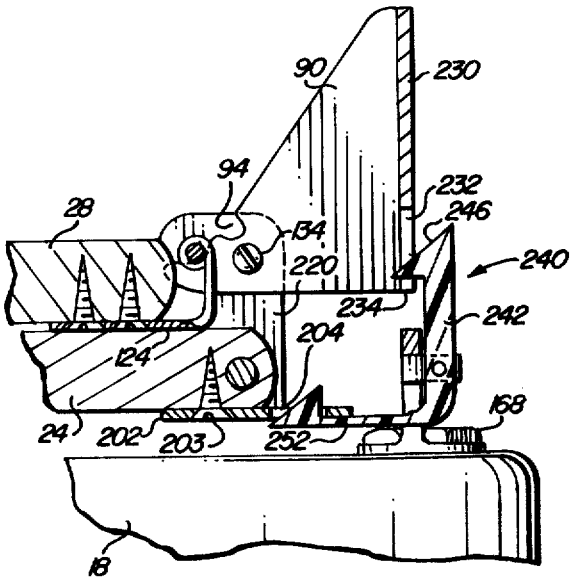
FIG. 9 is an enlarged view in partial section of a portion of the apparatus of FIG. 8 taken generally along line 9—9 of FIG. 8.

FIG. 9 is a view in partial section of the apparatus of FIG. 8, taken generally along line 9—9 of FIG. 8, and showing the toilet seat 24 in the full "down" and locked position. While the apparatus of FIG. 8 is shown in an exploded view, with the toilet seat removed, the toilet seat 24 and its cover 28 are illustrated in FIG. 9.

In place of the brackets 100 and 110 of FIGS. 1–6, to which the toilet seat 24 and its cover 28 are secured, a single bracket 200 is illustrated in the embodiment of FIGS. 8 and 9. The bracket 200 is a generally "U" shaped bracket with a pair of vertically extending side plates 210 and 220. The side plates 210 and 220 extend upwardly substantially perpendicular to the bottom cross plate 202 and are parallel to each other. At the front upper portion of each of the side plates 210 and 220 is a rounded surface 212 and 222 respectively. Spaced downwardly from the rounded surfaces 212 and 222 are a pair of holes 214 and 224 which receive the ends of a rod, such as the rod 120, best seen in FIG. 3. The rod is appropriately secured to the side plates 210 and 220. Adjacent to the holes 214 and 224, and aligned with the holes, are a pair of slots 216 and 226, which correspond to the aligned slots 106 and 116, of the embodiment of FIGS. 1–6. The pivoting motion and axial motion of the toilet seat and the bracket 200 are accordingly made possible by the cooperating notches into which the rod, which extends through the holes 214 and 224, moves and the movement of the bracket 200 thus corresponds to the movement of the slots 216 and 226, relative to appropriate bolts, as discussed above.

Extending through the bottom cross plate 202 is a generally rectangular hole or aperture 204. A rear locking frame member 206 extends outwardly from the main portion of the cross plate 202 to define the rearward or outer frame member for the aperture or hole 204.

The upper or top portions of the rods 42 and 52 are secured to a bracket similar to the bracket 70, illustrated above. However, rather than having a solid plate, such as plate 72, best illustrated in FIG. 3, a plate 230 is shown which includes a generally rectangular hole or aperture 232, which is not dissimilar in appearance from the hole or aperture 204 in the plane 202. A bottom cross piece 234 defines the lower portion of the hole or aperture 232, and it serves as a blocking member, similar to the rear member 206 of the plate 202. Extending forwardly from the plate 230 are the flanges 80 and 90, substantially as illustrated in FIGS. 3–6, and as discussed above.

As shown in FIG. 9, the toilet seat cover 28 is secured to the rod 120 by the bracket 124, as discussed in detail above. The toilet seat 24 is in turn secured to the bottom plate 202, by appropriate fastening means, such as a plurality of screws 203.

Figure 10:
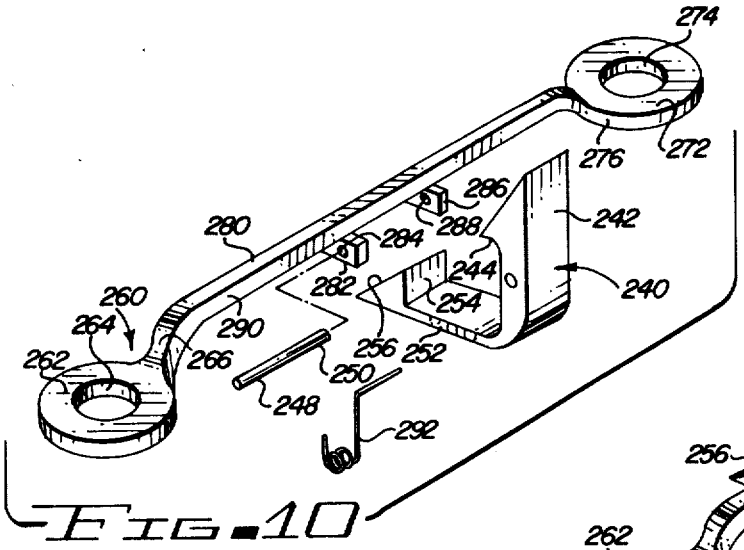
FIG. 10 is an exploded perspective view of the locking or latch apparatus shown in FIGS. 8 and 9.
Figure 11:
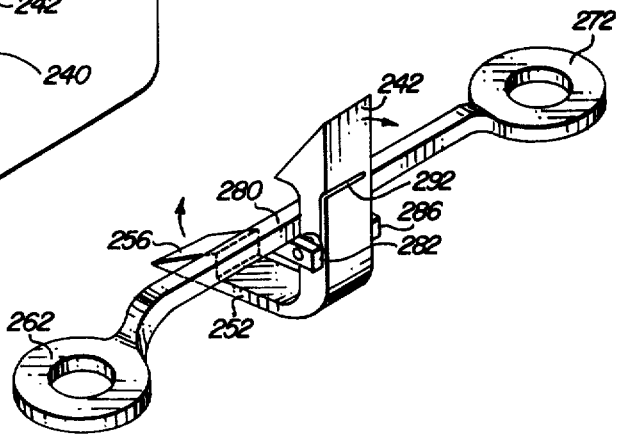
FIG. 11 is a perspective view of the locking or latch apparatus of FIG. 10 shown assembled.

A latch member 240, which is generally an "L" shaped member, includes a pair of lock or latching members which cooperate with the holes or apertures 204 and 232 to lock the toilet seat in the down position and to release the toilet seat to allow the toilet seat to move upwardly on rods 42 and 52. FIGS. 10 and 11 comprise perspective views of the latch member 240 and in the following explanation, reference should be made to FIGS. 8, 9, 10, and 11. The latch member 240 pivots on a cross bar 280 of a latching frame 260 which is disposed on the top surface of the flange 18 of the toilet 10. Preferably, the latch frame includes, as best shown in FIG. 10, a pair of generally circular plates 262 and 272 which in turn both include a pair of holes 264 and 274, respectively. The plates 262 and 272 preferably rest on the top surface of the flange 18, and the upper portion of the bushing 160 (see FIG. 6) extends through the holes 264 and 274. In turn, the upper retainer nuts 166 and 168 hold both the bushings and the latch frame securely in place (see FIG. 8).

Extending upwardly from the plates 262 and 272 are a pair of vertical arms 266 and 276, respectively (see FIG. 10). The height of the vertical arms 266 and 276 corresponds to the pivoting distance of the latch member 240, which pivots from a pair of lugs or arms 282 and 286. The arms 282 and 286 extend downwardly and rearwardly from a crossbar 280. The crossbar 280 is in turn secured to the vertical arms 266 and 276. Preferably, the cross-sectional configuration of the crossbar 280 is generally square or rectangular so as to provide a relatively flat vertical face 290 which acts as a stop for a portion of the latch member 240.

The latch member 240, as indicated above, is a generally "L" shaped member which includes a vertical arm 242 and a horizontal arm 252. Extending outwardly from the vertical arm 242 is a pair of pivot pins 248 and 250, which extend into the holes or apertures 284 and 288 of the arms 282 and 286 of the cross member 280. The lugs or arms 282 and 286 are disposed beneath the crossbar 280 and are dimensioned to provide that the vertical arm 242 will be disposed against the face 290 of the cross member when the apparatus is in both the upward and unlocked and the downward and locked positions.

The relative thickness of the horizontal arm 252 of the latch member 240 is less than the thickness of the vertical arm 242, and the vertical arm 242 is accordingly relatively stiff, while the horizontal arm 252 is able to flex, as will be discussed in detail below. It will be noted from FIG. 10 that the pivot pins 248 and 250 are disposed outwardly from the vertical arm 242 a distance above the juncture of the vertical and horizontal arms of the latch member. This allows the latch member 240 to pivot on the pivot pins to provide a forward and upward pivoting movement of the horizontal arm 252 and a corresponding rearward and downward pivoting movement of the vertical arm 242 for releasing the plate 230 to allow upward movement of the toilet seat under the upward bias of compression springs 60 and 62.

Each of the arms of the latch member 240 include a lock surface, defined respectively as lock surfaces 244 and 254, which extend substantially perpendicularly to the arms 242 and 252, respectively. The arms also include cam faces 246 and 256, which extend in a sloping manner from the distal edge of the lock surfaces 244 and 254 towards the arms 242 and 252, respectively. The cam faces are used in the locking of the toilet seat in the down position by contacting initially the frame members or cross pieces 206 and 234 of the bracket 200 and the plate 230, respectively.

The side plates 210 and 220 of the bracket 200 are substantially identical to the side plates 100 and 110, as discussed above, and accordingly the side plates 210 and 220 cooperate with the flanges 80 and 90 in substantially the same manner as previously illustrated and as discussed. The movement of the seat 24 with the latch member 240 and the locking means illustrated in FIGS. 8, 9, and 10, is accordingly substantially the same as the movement of the seat 24 illustrated in the embodiment of FIGS. 1-6. The primary difference is, of course, in the specific latching and releasing mechanism. With the seat in the full "down" position, such as shown in FIG. 9, a forward movement of the seat 24, and of course with the seat cover 28, causes the rear member or cross-piece 206 of the bracket 200 to exert a forward pull on the lock surface 254 of the horizontal member 252. The forward movement of the horizontal member 252 is accompanied by a rearward movement of the vertical member 244 of the latch 240 which causes the lock surface 244 to disengage with the frame member 234 of the plate 230. When the vertical member 242 pivots rearwardly to disengage the frame member or cross piece 234, the plate 230, as attached to the seat 24, is then moved upwardly under the bias of the springs 60 and 62 to cause the entire seat to move upwardly with the upward movement of the rods 42 and 52. It will be noted that the forward movement of the seat 24 to disengage the vertical arm 242 of the latch member 240 is also accompanied by an upward tilt of the seat 24. The combination forward and upward movement of the seat 24, followed by the vertical movement, as opposed to the outward pivoting of the seat 24, results in the movement of the rear frame member 206 of the bracket 200 away from the surface 254 of the latch member 240 to completely release the seat from the latch member 240. The pivoting motion of the latch member 240 on its pivot pins 248 and 250, as shown in FIG. 10, thus allows the disengagement of the latch member from within the respective apertures 204 and 232 of the bracket 200 and the plate 230, respectively, to allow the seat to move upwardly under the bias of the compression springs 60 and 62.

When the seat 24 has cleared the latch member 240, the latch member 240 returns to its orientation as shown in FIGS. 8 and 9, with the front face of the vertical member 244 disposed against the vertical face 290 of the cross bar 280 under the bias of the spring 292, in a well-known manner.

As the latch 240 pivots on its pivot pins 248 and 250 in the release of the bracket 200 and the plate 230, there may be contact between the latch member 204 on the cam surface or face 256 of the horizontal arm or member 252 of the latch 240. The opposite may occur when the seat 24 is returned to its "down" position to lock the seat in the "down" position. With the vertical arm 242 of the latch member 240 in its normal, or rest, position, the frame member 234 makes initial contact with the vertical arm 242 against the cam surface 246 of the arm. This initial contact causes the latch member 240 to pivot outwardly until the frame member 234 is clear of the cam surface 246. At that time, the latch member 240 pivots under the bias of spring 292 to its original position and a portion of the vertical arm extends into the aperture 232. The lock surface 244 engages the frame member 234 to lock the plate 230, and the seats attached thereto, in the "down" position.

As described previously, as the seat is lowered to its "down" position, the cross piece 206 engages with the cam surface 256, flexing the horizontal member 252 until cross piece 206 is resting against the lock surface 254 and the top surface of horizontal member 252.

Instead of having a discrete spring 292 biasing the latch member 240 to the vertical position, the entire bar 280 may be spring biased with the latch member 242 secured thereto. Accordingly, movement of the latch member 240 would result in movement of the bar 280, with the bar 280 biased to its normal position illustrated in FIGS. 8, 9, and 11.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Lifting apparatus for a toilet seat, comprising, in combination:

a toilet having a bowl, a rim extending about the bowl, and a flange extending rearwardly from the rim;

first rod means secured to and movable through the flange of the toilet;

toilet seat means secured to the first rod means and pivotally movable relative to the first rod means and movable with first rod means between a down position and an up position;

spring means disposed between the flange of the toilet and the toilet seat means for biasing the toilet seat means and the first rod means to the up position;

lock means secured to the first rod means for locking the toilet seat means and the first rod means in the down position;

bracket means secured to the rod means and movable therewith;

flange means secured to the bracket means;

recess means on the flange means;

plate means secured to the toilet seat means and to the bracket means and including slot means, fastening means extending through the slot means and through the bracket means for securing together the plate means and the flange means; and second rod means secured to the plate means and movable into the recess means to lock the toilet seat means relative to the bracket means and the flange means.

2. The apparatus of claim 1 in which the toilet seat means includes a splash shield secured to the toilet and movable with the toilet seat means.

3. The apparatus of claim 1 in which the first rod means includes a pair of rods.

4. The apparatus of claim 3 in which the spring means comprises a pair of compression springs, and one spring of the pair is disposed respectively about one rod of the pair of rods.

5. The apparatus of claim 4 in which the lock means comprises a notch in one of the rods of the first rod means, and a first pin secured to the flange of the toilet movable into the notch to lock the first rod means and the toilet seat means in the down position and movable out of the notch to allow the first rod means and the toilet seat means to move to the up position.

6. The apparatus of claim 5 in which the lock means further includes a locking cam secured to the first pin for moving the first pin out of the notch.

7. The apparatus of claim 6 in which the toilet seat means further includes a second pin disposed against the locking cam for moving the locking cam to move the first pin out of the notch in one of the rods as the toilet seat means is pivoted on the first rod means.

8. The apparatus of claim 4 in which the lock means comprises:

a first aperture in the bracket means;

a second aperture in the plate means;

a cross bar secured to the flange means of the toilet;

latch means pivotally secured to the cross bar and including a first member engaging the first aperture to the bracket means to lock the first rod means and the toilet seat means in the down position.

9. The apparatus of claim 8 in which the latch means includes a second member engaging the second aperture in the plate means for pivoting the latch means to release the engagement of the first member and the first aperture when the toilet seat means is pivoted relative to the first rod means.

10. The apparatus of claim 4 in which the flange means includes a stop means against which the second rod means is disposed to hold the toilet seat means in a horizontal position relative to the first rod means and the flange means.

11. The apparatus of claim 10 in which the flange means further includes a cam means between the stop means and the recess means and the second rod means moves over the cam means as the toilet seat means pivots relative to the first rod means.

12. The apparatus of claim 11 in which the bracket means includes a plate extending between and secured to the rods of the first rod means.

13. The apparatus of claim 12 in which the flange means comprises a pair of flanges spaced apart from each other and secured to the plate of the bracket means.

14. The apparatus of claim 13 in which the recess means comprises a recess in each of the flanges of the pair of flanges.

15. The apparatus of claim 14 in which the stop means comprises a stop on each of the flanges of the pair of flanges.

16. The apparatus of claim 15 in which the cam means comprises a cam portion on each flange of the pair of flanges extending between a stop and a recess.

17. The apparatus of claim 16 in which the plate means comprises a pair of plates secured to the toilet seat means and disposed adjacent the pair of flanges of the flange means.

18. The apparatus of claim 17 in which the second rod means comprises a rod secured to and extending between the pair of plates.

19. The apparatus of claim 18 in which the slot means comprises a slot in each of the plates of the pair of plates and the fastening means moves in the slot means as the second rod means moves on the cam means and in the recess means.

* * * * *